US005485358A

United States Patent [19]

Chien

[11] Patent Number: 5,485,358

[45] Date of Patent: Jan. 16, 1996

[54] UNIVERSAL L.E.D. SAFETY LIGHT FOR HEAD-WEAR

[76] Inventor: Tseng L. Chien, P.O. Box 56-104, Taipei, Taiwan

[21] Appl. No.: 245,019

[22] Filed: May 18, 1994

[51] Int. Cl.[6] ..... F21L 15/14

[52] U.S. Cl. ..... 362/106; 362/103; 362/105

[58] Field of Search ..... 2/195.2, 195.3, 2/195.4, 906, 918; 362/103, 105, 106, 108, 800

[56] References Cited

U.S. PATENT DOCUMENTS

| | | | |
|---|---|---|---|
| 1,572,210 | 2/1926 | Kolibas | 362/106 |
| 4,231,079 | 10/1980 | Heminover | 362/800 |
| 4,901,210 | 2/1990 | Hanabusa | 362/106 |
| 5,111,366 | 5/1992 | Rife et al. | 362/106 |
| 5,272,772 | 12/1993 | Hahn | 2/195.2 |

FOREIGN PATENT DOCUMENTS

| | | | |
|---|---|---|---|
| 2221025 | 1/1990 | United Kingdom | 362/800 |

*Primary Examiner*—Ira S. Lazarus
*Assistant Examiner*—Y. Quach
*Attorney, Agent, or Firm*—Bacon & Thomas

[57] ABSTRACT

A lighting arrangement for head-wear is made up of several light emitting diodes mounted on a flexible plate. The flexible plate is one of the straps of the length-adjustable belt conventional provided at the rear of a cap. The strap on which the LED is mounted may be stitched to the rear of the cap in conventional fashion and used for length adjustment purposes or may alternatively by stitched to the side of the cap to be used solely as a mounting for the lighting arrangement.

5 Claims, 4 Drawing Sheets

UNIVERSAL L.E.D. SAFETY LIGHT FOR HEAD-WEAR

BACKGROUND OF THE INVENTION

The current invention involves an improvement over arrangements for putting a light on an existing cap or head-wear component. The invention uses an existing cap's rear end, length-adjustable belt to support the light and thereby save production costs and simplify the structure. One can also, using the same "length-adjustable belt" tooling, provide a single piece of the length-adjustment belt for stitching on the side of the cap or head-wear. Whether on the side or back, the invention adds to any cap an eye-catching light show for use during night time activities or for increasing the fun of outdoor activities in general.

SUMMARY OF THE INVENTION

A light device with several light emitting diode or diodes is arranged to be mounted on the soft and flexible belt which is a part of conventional caps, in order to provide length or cap-size adjustment at the rear of the cap. The mounting also can be on a single piece of adjustable length belt which has been stitched on a side of the cap or other location suitable for warning purposes. By using the existing soft/flexible plate material of the length-adjustment belt and by not spending for expensive tooling, a user's safety can be enhanced at low cost while providing lighting at the rear end or side of the cap. The plate or frame design utilizing the length-adjustable belt is easily stitched on any soft material such as cloth, leather, PVC, or wool to form a head-wear.

The LED drivers may be in the form of a conventional electric circuit or an integrated circuit which drives the D.C. power battery to trigger the LED or LEDs and provide a light show. The light show may include flashing, steady, fade-in-out, sequential, or chasing effects. The circuitry is completely conventional, however, and therefore not described in detail herein. The components may include, for example, a diode, transistor, capacitor, integrated circuit, D.C. battery, and switch, all of which are provided on the printed circuit board.

The current invention may be applied to all existing head-wear and provides a brilliant light for personal safety with very low cost. The invention only requires an LED and circuit board with some Velcro™ to fix on the inner edge of the conventional cap or head-wear.

The primary object of the present invention is thus to provide a useful illuminated universal LED safety light for head-wear. The objects of the invention will become clearer from an inspection of the detailed description of the invention and from the appended claims.

DETAILED DESCRIPTION OF THE PREFERRED EMBODIMENTS

Figure 1:
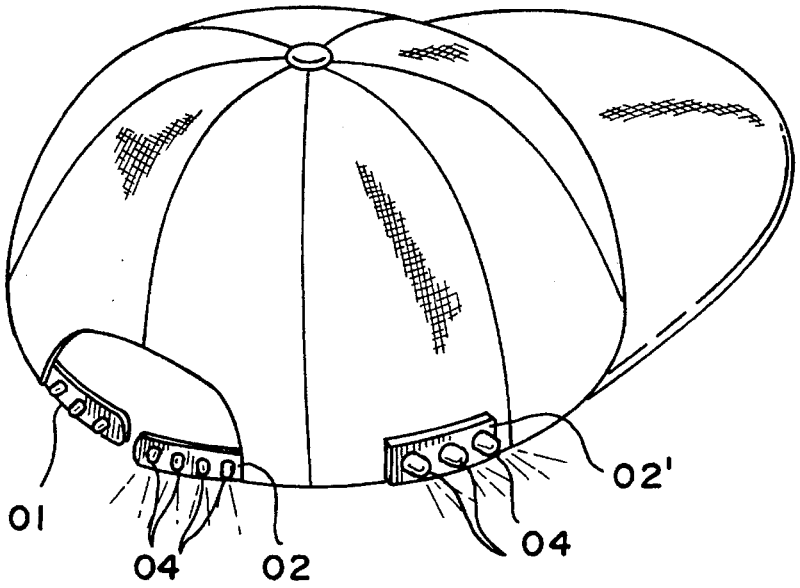
FIG. 1 is a perspective view of an application of the invention
Figure 2:
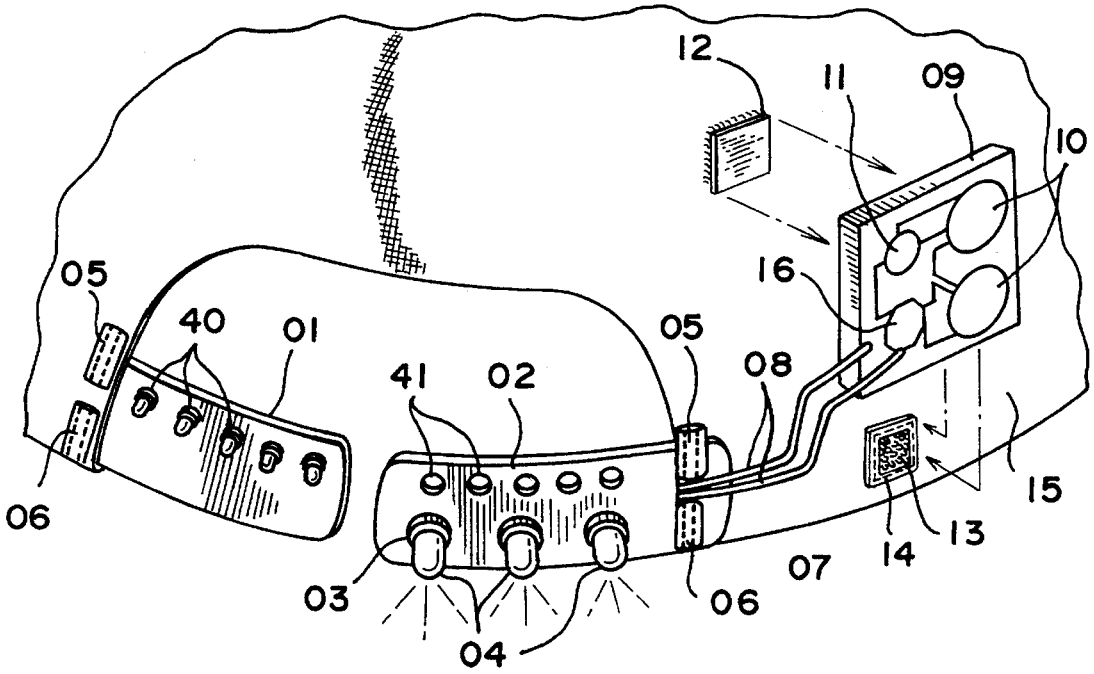
FIG. 2 is a schematic view showing a construction of the current invention in which the lighting is applied to an existing cap's length-adjustable belt

The preferred universal LED safety light for head-wear shown in FIG. 1 uses an existing rear end "length-adjustable belt" made up of straps (01) and (02), one of which includes projections (40) and the other of which includes holes (41) having diameters approximately the same as the holes for adjusting, as is known, the size of the cap. Strap (02) further includes three round holes (03) for holding several light emitting diodes (04) on one side. By stitching two straps (01) and (02) of the adjustable length belt on the cap itself using separate stitches (05) and (06), a channel (07) can be provided to let wire harness (08) pass through to the inner side of cap to be connected with an electric circuit board (09). Electric circuit board (09) has a built-in D.C. power supply or batteries (10), and a conventional or integrated circuit (11) for triggering the LED (04) to exhibit special effects such as flashing, sequential, random, fade in-out, chasing, etc. One on-off switch (16)is also included on the electric circuit board to provide a system on-off function. The circuit board (09) is attached to the cap by two pieces of Velcro™ (12) and (13), one of which is stitched to a proper location in the inner part of the cap and the other of which is attached to the board.

Figure 3:
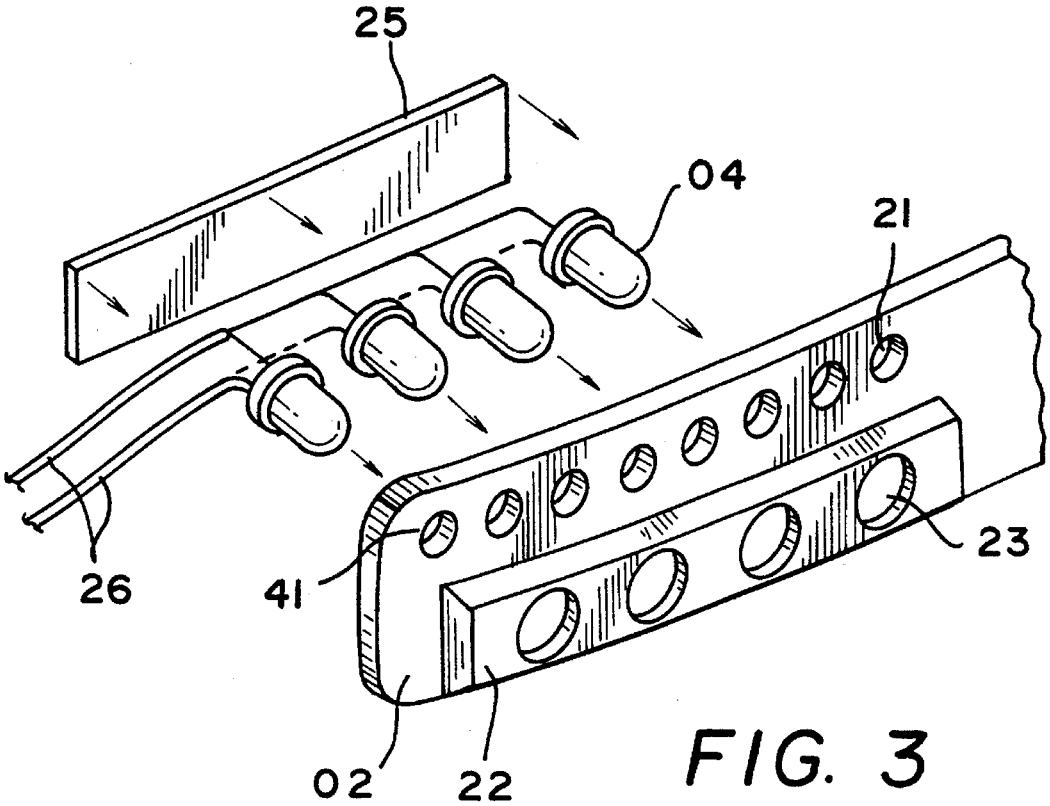
FIG. 3 is a schematic view showing details of the manner in which the light emitting diode is placed on a conventional length-adjustable belt.

FIG. 3 shows the construction of a revised "adjustable length belt" with several round hole or holes to catch the projections of the other piece. A raised surface (22) is designed for containing the LED or LEDs (04) in holes (23) to fix the LED at a proper location. A back panel (25) covers the wire harness (26) and the portions of the LEDs (64) inside of the raised surface (22) to provide a solid light container with two LED lead wires extending to the electric circuit board.

Figure 4:
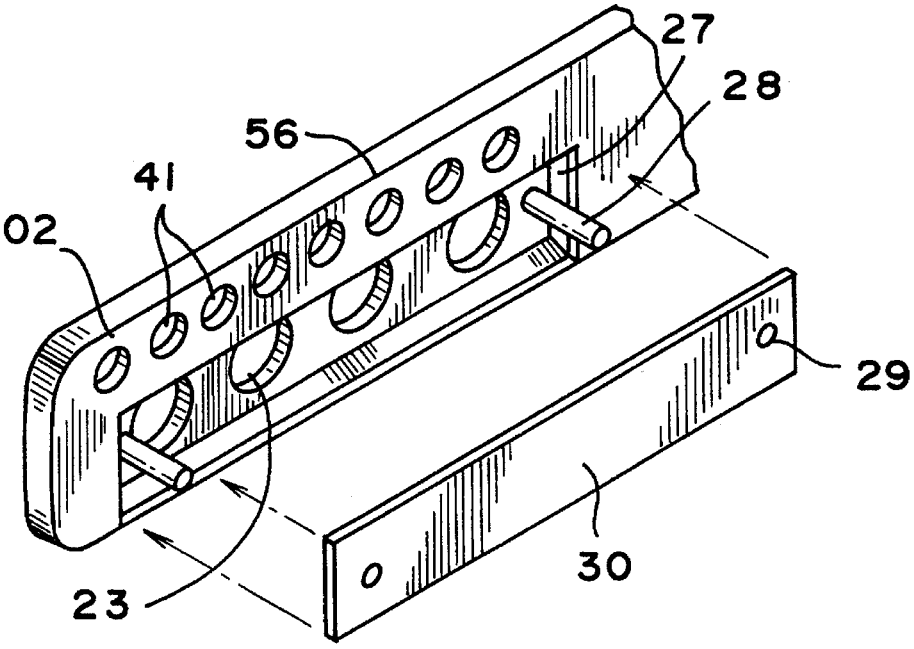
FIG. 4 is a schematic view showing a back side of the embodiment shown in FIGS. 1–3.

From FIG. 4, we can easily see how the back plate (30) is held on the rear surface (56) of the adjustable length belt. A lower level recess (27) is provided to keep the back plate at the same level with rear surface (56). Several plastic projections (28) higher than the surface (56) of the belt pass through the holes (29) and are affixed using a soldering gun to melt the projections (28) secure back plate (30) to the belt.

Figure 5:
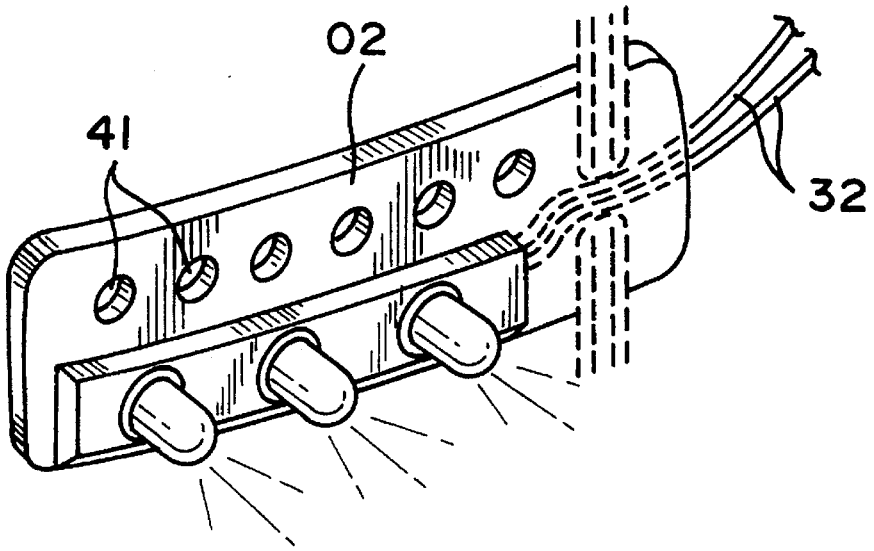
FIG. 5 is a schematic view showing a stitch method for applying the light to the length-adjustable belt at the rear end of the cap.
Figure 7:
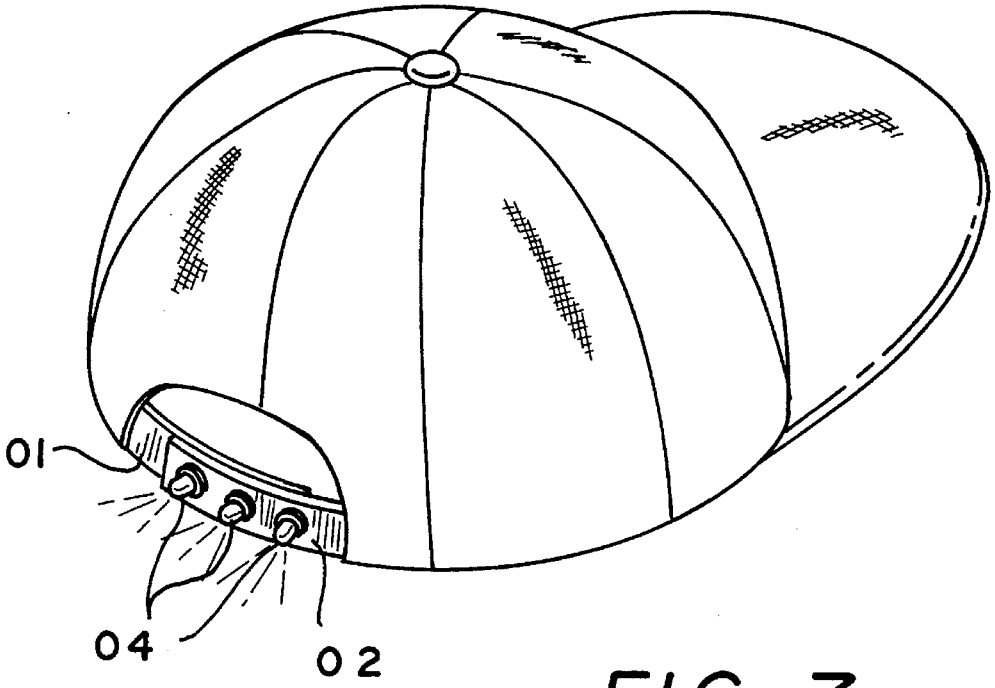
FIG. 7 is a perspective view of a cap incorporating the light of the present invention in a first embodiment.

FIG. 5 shows details of the stitches used to hold the "adjustable length belt" made up of straps (01) and (02) on the cap in the manner also illustrated in FIG. 7. Two disconnected stitches on two sides of the belt allow two wire harnesses (32) to pass through the channel and into the inner part of cap to connect with the above-described electric circuit board.

Figure 6:
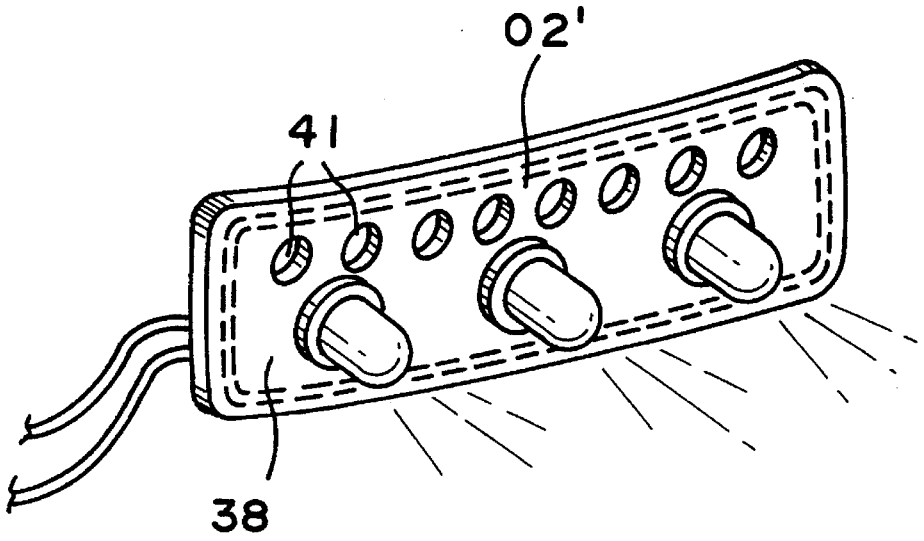
FIG. 6 is a schematic view showing a stitching method for applying the light on a single adjustable belt on the side of the cap.
Figure 8:
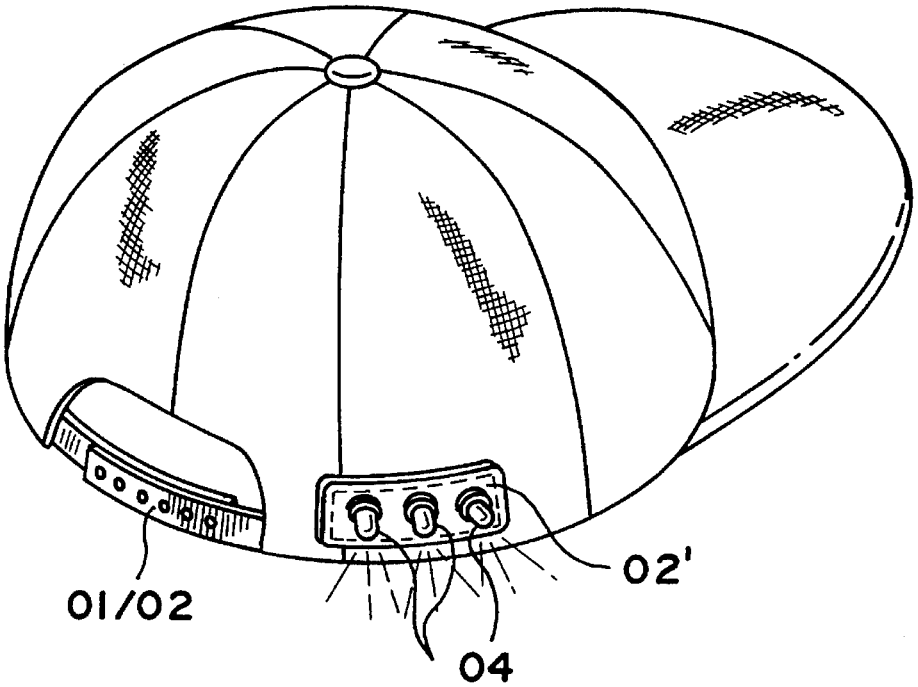
FIG. 8 is a perspective view of a cap incorporating the light of the present invention in a second embodiment.

FIG. 6 shows another stitching arrangement for holding a single strap (02) of the "adjustable length belt" on the surface of cap, the stitching extending partially or completely around the edge of the single strap (02)', which can thus be used in a side-mounted lighting arrangement of the type shown in FIG. 8 without the need for extra tooling other than that already used to make the adjustable-length belt.

I claim:

1. In head-wear, comprising:

an adjustable-length belt made up of two straps secured to the head-wear, a first of said straps includes a plurality of holes and a second of said straps includes a plurality of projections arranged to fit within the holes to secure said first of the straps to the second of said straps, the relative position of the straps secured together determining a size of the head-wear, the improvement comprising:

a lighting arrangement made up of at least one LED mounted in at least one LED mounting hole in one of the first and second straps, wherein said one of the first and second straps is secured to the head-wear by stitches at one end of the strap, and wherein lead wires for the LED extended through a channel in the stitches to a circuit board mounted inside the head-wear.

2. Head-wear as claimed in claim 1, wherein the circuit board is fastened to the head-wear by Velcro™.

3. Head-wear as claimed in claim 1, wherein the circuit board includes LED driver circuitry.

4. Head-wear as claimed in claim 1, wherein said strap on which the LED is mounted includes on a front surface a raised portion surrounding said LED mounting hole in which the LED is positioned, and wherein said strap on which the LED is mounted further includes, behind the raised portion, a recess covered by a back plate which is flush with a back surface of the strap.

5. Head-wear as claimed in claim 4, wherein said back plate is secured to the strap by openings in the back plate and projections extending from the raised portion and fit through the openings, said projections being melted to secure the back plate to the strap.

* * * * *